US012753998B2

(12) United States Patent
Lessard

(10) Patent No.: US 12,753,998 B2
(45) Date of Patent: Oct. 6, 2026

(54) SUBSONIC FIREARM CARTRIDGE

(71) Applicant: Q, LLC, Dover, NH (US)

(72) Inventor: Ethan Michel Lessard, Dover, NH (US)

(73) Assignee: Q, LLC, Dover, NH (US)

( * ) Notice: Subject to any disclaimer, the term of this patent is extended or adjusted under 35 U.S.C. 154(b) by 184 days.

(21) Appl. No.: 18/659,056

(22) Filed: May 9, 2024

(65) Prior Publication Data

US 2024/0377171 A1 Nov. 14, 2024

Related U.S. Application Data

(60) Provisional application No. 63/501,638, filed on May 11, 2023.

(51) Int. Cl.

| | |
|---|---|
| ***F42B 5/02*** | (2006.01) |
| ***F42B 5/26*** | (2006.01) |
| *F42B 5/28* | (2006.01) |
| *F42B 5/30* | (2006.01) |

(52) U.S. Cl.

CPC ..... *F42B 5/025* (2013.01); *F42B 5/02* (2013.01); *F42B 5/26* (2013.01); *F42B 5/28* (2013.01); *F42B 5/30* (2013.01)

(58) Field of Classification Search

CPC .... F42B 5/00; F42B 5/02; F42B 5/025; F42B 5/26; F42B 5/28; F42B 5/285; F42B 5/30; F42B 5/307

USPC ..... 102/430, 464–470

See application file for complete search history.

(56) References Cited

U.S. PATENT DOCUMENTS

| | | | | |
|---|---|---|---|---|
| 8,011,301 | B1 * | 9/2011 | Sloan | F42B 5/26 102/464 |
| 2011/0214583 | A1 * | 9/2011 | Dutch | F42B 5/26 102/464 |
| 2013/0014664 | A1 * | 1/2013 | Padgett | F42B 33/02 102/466 |
| 2015/0241183 | A1 * | 8/2015 | Padgett | F42B 8/04 102/466 |
| 2018/0065183 | A1 * | 3/2018 | Skowron | B22F 3/225 |
| 2019/0120601 | A1 * | 4/2019 | Beal | F42C 19/0807 |

(Continued)

FOREIGN PATENT DOCUMENTS

| | | | | |
|---|---|---|---|---|
| WO | WO-2008090505 | A2 * | 7/2008 | F42B 5/26 |

*Primary Examiner* — James S Bergin
(74) *Attorney, Agent, or Firm* — EVERSHEDS SUTHERLAND (US) LLP

(57) ABSTRACT

Firearm cartridges are provided. The firearm cartridge includes a projectile and a cartridge case. The cartridge case includes head, body, shoulder, and neck sections. The cartridge case further includes a case wall. The case wall defines a chamber that extends from the head section to the neck section and has at least a first thickness about the body section and a second thickness about the shoulder section, the second thickness being less than the first thickness. The case wall about the shoulder section defines a hollow volume. The case wall about the neck section engages with the projectile, and the case wall about at least at least a portion of the body section is in contact with the projectile. The chamber is separated into a first chamber portion within the body section and a second chamber portion within the shoulder section by an engagement between the projectile and the wall.

17 Claims, 4 Drawing Sheets

(56) References Cited

U.S. PATENT DOCUMENTS

2023/0103234 A1* 3/2023 Murchison ..... F42B 12/74
102/439

* cited by examiner

SUBSONIC FIREARM CARTRIDGE

This application is related to, and claims the benefit of, U.S. Provisional Patent Application No. 63/501,638, filed May 11, 2023, the entire contents of which are incorporated herein by reference.

TECHNICAL FIELD

The present application generally relates to ammunition for firearms.

BACKGROUND

Firearm cartridges may be associated with a variety of loads, including supersonic, or high-velocity, loads, and subsonic, or reduced-velocity, loads. A given load may be associated with a certain amount of a propellant loaded into a cartridge case of a firearm cartridge. Alternatively, or in addition, the given load may be associated with a projectile inserted into the cartridge case (as well as a certain position to which the projectile may be inserted). As compared to a supersonic load, a subsonic load may be associated with a reduced amount of the propellant and/or a heavier projectile inserted to a different position within the cartridge case, which may be designed or modified in an attempt to accommodate the reduced amount of the propellant and/or the different positioning of the projectile.

In particular, existing cartridge cases associated with subsonic loads are ill-designed to provide for proper sealing of the cartridge case about the projectile during discharge of a firearm in which the firearm cartridge is chambered. Such sealing is known as obturation and is caused when pressurized gas, generated during the discharge of the firearm, deforms a case wall of the cartridge case from within the cartridge case. Due to various distinguishing characteristics of subsonic loads versus supersonic loads (e.g., reduced amount of the propellant and/or different positioning of the projectile), firearm cartridges having subsonic loads often suffer from undesirable obturation, which may result in relatively poor performance characteristics, such as inconsistent muzzle velocity and inaccuracy.

As shown in FIG. 1, for example, existing firearm cartridges attempt to solve for the issue of obturation by modifying the cartridge cases and, in particular, the case walls of the cartridge cases to provide for acceptable deformation during discharge. However, such modifications fail to account for the fact that subsonic loads typically leave a greater volume of empty space within the cartridge case due to the reduced amount of propellant required for subsonic operation. As such, the propellant is free to shift about within the cartridge case, particularly during adjustment of an attitude of the firearm in which the firearm cartridge is chambered. Because portions of the propellant may vary widely in position within the cartridge case, the propellant may be ignited and burn at an unreliable rate during discharge, which may cause the poor performance characteristics noted above. At present, the only purported solutions for such inconsistent burn rates involve use of additional components or sealants, which are categorically unreliable and unwieldy.

Accordingly, there is a need for improved firearm cartridges associated with subsonic or reduced-velocity loads.

BRIEF DESCRIPTION OF THE DRAWINGS

These and other features, aspects, and advantages of the present invention will become apparent from the following description, the appended claims, and the accompanying example embodiments shown in the drawings, which are briefly described below:

DETAILED DESCRIPTION

The present disclosure provides for a firearm cartridge. The firearm cartridge may include a cartridge case having a case wall of varying thickness (and, therefore, varying strength or weakness), which may facilitate preferable deformation of the case wall about certain sections when the firearm cartridge is discharged from a firearm (i.e., during obturation). The varying thickness of the case wall may be produced by selectively thinning the case wall from within the cartridge case. In addition to providing a case wall with optimized points of strength and weakness to facilitate obturation, such selective thinning of the case wall may further improve performance of the firearm cartridge over different firearm cartridges by restricting a propellant, loaded into the cartridge case, to a limited volume within the cartridge case, For example, inserting a projectile into the cartridge case may separate the limited volume containing the propellant from a different volume of the cartridge case produced during the selective thinning of the case wall. These and other improvements of the firearm cartridge described herein may prove particularly beneficial when the firearm cartridge is associated with a reduced-velocity or subsonic load, as such loads often exacerbate issues with burn rate and obturation that are inherent in existing firearm cartridges.

In further detail, the firearm cartridge may include a projectile and a cartridge case. The cartridge case may include a head section, a body section adjacent to the head section, a shoulder section adjacent to the body section, and a neck section adjacent to the shoulder section. The cartridge case may further include a case wall, the case wall defining a chamber that extends from the head section to the neck section and having at least a first thickness about the body section and a second thickness about the shoulder section. The second thickness may be less than the first thickness. The case wall about the shoulder may define a hollow volume. The case wall about the neck section may engage with the projectile, and the case wall about at least a portion of the body section may be in contact with the projectile. The chamber may be separated into a first chamber portion within the body section and a second chamber portion within the shoulder section by an engagement between the projectile and the case wall.

Figure 1:
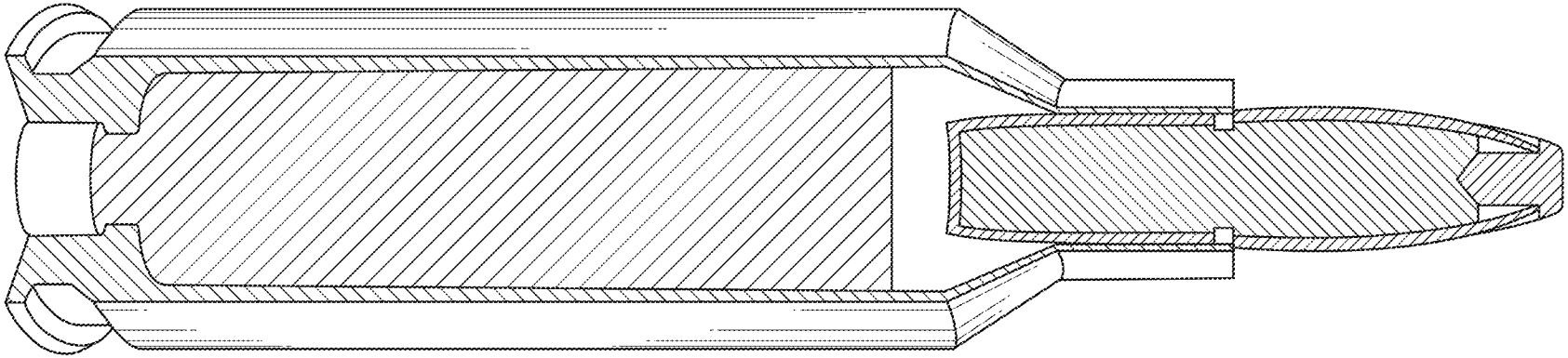
FIG. 1 (Prior Art)
FIG. 1 is a cross-sectional view of a firearm cartridge.
Figure 2:
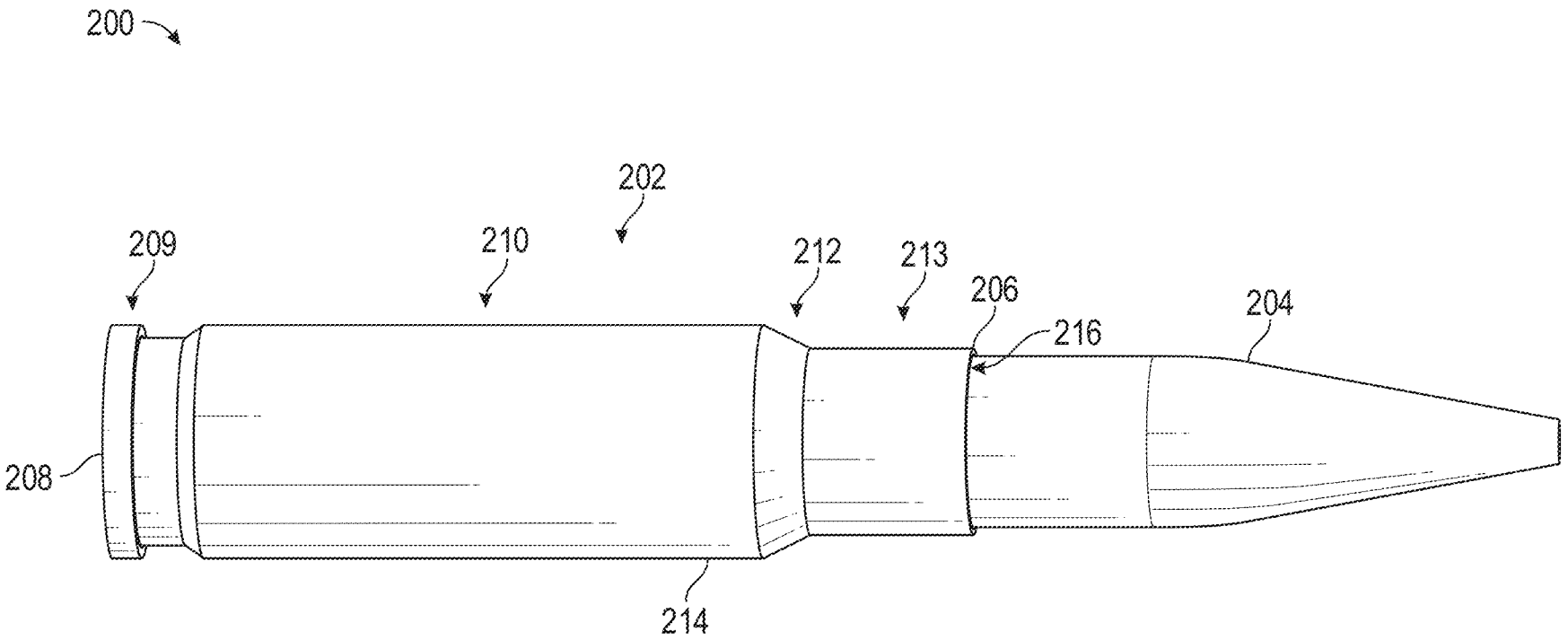
FIG. 2 is a side view of a firearm cartridge in accordance with one or more example embodiments of the disclosure.

Referring now to FIG. 2, and in brief overview, an example firearm cartridge in accordance with one or more embodiments of the present disclosure is illustrated. As shown in FIG. 2, firearm cartridge 200 may include cartridge case 202 and projectile 204. The cartridge case 202 may be defined by an outer profile extending transversely from proximal end 206 to distal end 208. The cartridge case 202 may include head section 209, body section 210, shoulder section 212, and neck section 213. The body section 210, the shoulder section 212, and the neck section 213 may be formed by case wall 214.

The cartridge case 202 may include mouth 216 at proximal end 206, which may define an opening to a chamber (not shown in FIG. 2) into which the projectile 204 may be inserted from the proximal end 206. The projectile 204 may be inserted into the chamber to a predetermined distance from the distal end 208 and/or the head section 209. For example, the projectile 204 may be inserted into the mouth 216 through the neck section 213, the shoulder section 212, and at least a portion of the body section 210, such that an inserted end of the projectile 204 may sit within the body section 210.

The case wall 214 may be designed to be crimped, with the projectile 204 inserted in the chamber of the cartridge case 202, about the neck section 213 near the proximal end 206 (e.g., at mouth 216). Crimping the case wall 214 at the mouth 216 may be accomplished, for example, by a taper-crimping process or a roll-crimping process. Taper-crimping may involve restoring a flared portion of the case wall 214 to its original dimensions once the projectile 204 has been seated within the cartridge case 202. In addition to restoring the flared portion of the case wall 214 (as with taper-crimping), roll-crimping may also involve pressing a portion of the case wall 214 into a groove, or cannelure, of the projectile 204 (not shown). With either taper-crimping or roll-crimping, the case wall 214 may, once crimped, hold the projectile 204 within the cartridge case 202 via surface tension and/or pressure. Roll-crimping may further prevent travel of the projectile 204 within the cartridge case 202 due to the restriction of movement about the pressed portion of the case wall 214 and the cannelure of the projectile 204. Generally, taper-crimping may be preferred when the firearm cartridge 200 is designed for use with semiautomatic handguns or rifles, whereas roll-crimping may be preferred when the firearm cartridge 200 is designed for use with revolvers and/or certain high-caliber firearms (e.g., firearms chambered in .357 Magnum or .44 Magnum). However, numerous other crimping processes and applications are further envisioned by the present disclosure.

The firearm cartridge 200 may be any firearm cartridge suitable for chambering in a firearm. For example, the firearm cartridge 200 may be a centerfire cartridge suitable for chambering in a centerfire handgun or rifle. The firearm cartridge 200 may be of any caliber of ammunition suitable for discharge from a firearm. For example, the caliber of the firearm cartridge 200 may be 5.7 millimeter, 7.62 millimeter, 8.6 millimeter Blackout, 9 millimeter, or any other suitable caliber of ammunition.

As further described below (with respect to firearm cartridge 300 illustrated in FIG. 3), the firearm cartridge 200 may be specifically designed to be discharged from a firearm at a reduced velocity as compared to a standard round of ammunition in a similar caliber. For example, the firearm cartridge 200 may be a subsonic firearm cartridge designed to operate at velocities below the speed of sound. By operating at such reduced velocities, the subsonic firearm cartridge may not produce a supersonic shockwave (associated with breaking the sound barrier) upon discharge from a firearm and may thereby avoid a loud bang (or "crack") otherwise associated with discharge of a supersonic round from the same firearm. In this manner, the firearm cartridge 200 may produce a comparably lesser noise when discharged from a firearm than would a standard (i.e., supersonic) firearm cartridge or round of ammunition.

In some embodiments of the firearm cartridge 200 designed to operate at reduced velocities, one or more characteristics of the projectile 204 may be selected to facilitate subsonic or reduced-velocity operation. For example, the projectile 204 may have an increased weight versus a comparable projectile intended for use within a supersonic firearm cartridge, and/or one or more materials from which the projectile 204 may be formed may be selected based on their density or other aerodynamic characteristics. Alternatively, or in addition, one or more dimensions of the projectile 204 may be determined such that the firearm cartridge 200 may operate at reduced velocities. For example, the projectile 204 may be designed with a blunted profile that may increase wind resistance versus a comparable projectile intended for use within a supersonic firearm cartridge and having a sharper taper.

Figure 3:
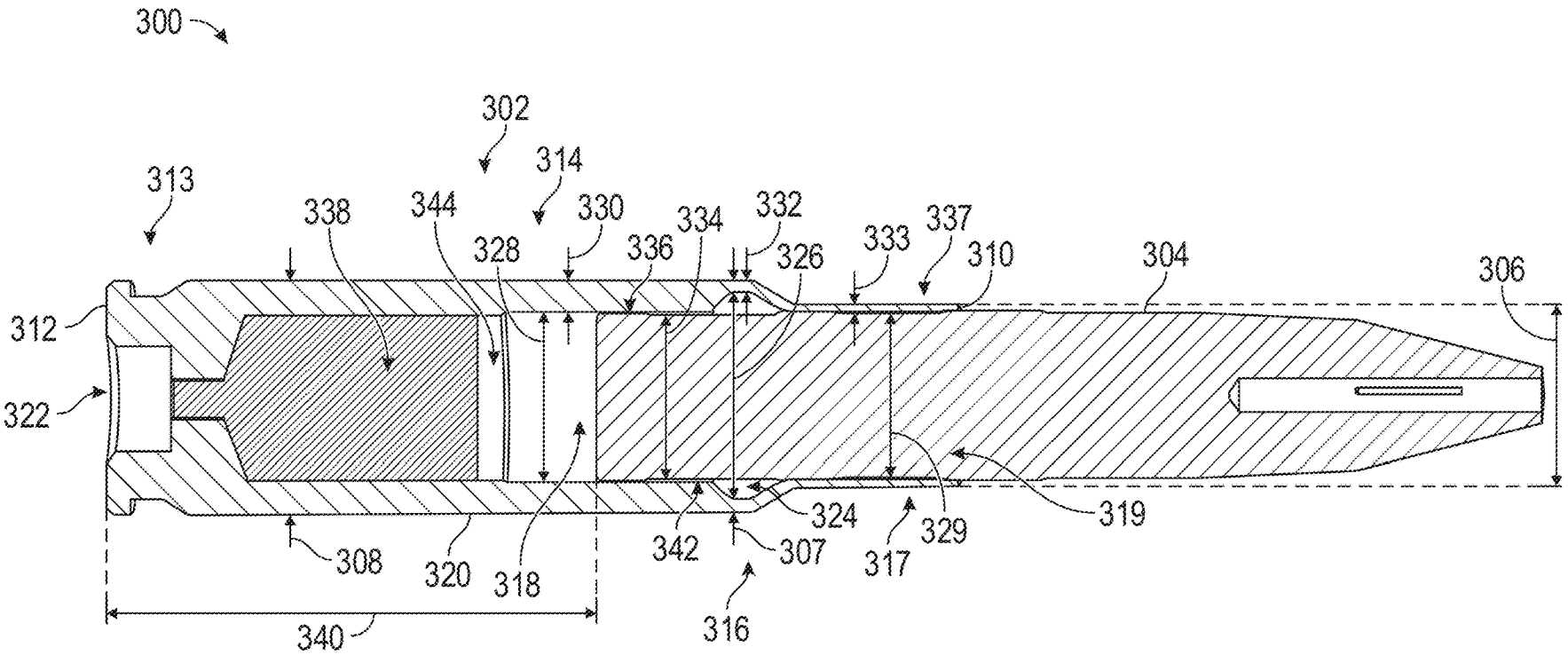
FIG. 3 is a cross-sectional view of a firearm cartridge in accordance with one or more example embodiments of the disclosure.

Referring now to FIG. 3, and in brief overview, an example firearm cartridge in accordance with one or more embodiments of the present disclosure is illustrated. As shown in FIG. 3, firearm cartridge 300 may include cartridge case 302 and/or projectile 304. The firearm cartridge 300 may be the same as or similar to firearm cartridge 200, or may be a different firearm cartridge. In a similar manner, various components associated with firearm cartridge 300 may be the same as or similar to various components associated with firearm cartridge 200, or may be different components.

The cartridge case 302 may be formed from a casing material. The cartridge case 302 may include head section 313, body section 314, shoulder section 316, and neck section 317 that may be defined by an outer profile extending transversely from proximal end 310 of the cartridge case 302 to distal end 312 of the cartridge case 302. The outer profile may have multiple diameters, such as diameter 306 at the neck section 317, diameter 307 at the shoulder section 316, and/or diameter 308 at the body section 314. The cartridge case 302 may include a case wall 320 that defines chamber 318 with mouth 319 and/or primer cup 322. The shoulder section 316 may be located between the body section 314 and the neck section 317 of the cartridge case 302. The shoulder section 316 may define hollow volume 324. The hollow volume 324 may have an inner profile defined by at least diameter 326. The chamber 318 may have inner diameter 328 and inner diameter 329 (which may be the same as or different than diameter 328) and/or may extend transversely from the proximal end 310, through the neck section 317, shoulder section 316, and toward the distal end 312 through at least a portion of the body section 314 of the cartridge case 302. The chamber 318 may be designed to receive the projectile 304 at the mouth 319 from the proximal end 310, for example, via insertion. The case wall 320 may have at least thickness 330 at the body section 314, defined by a difference between diameter 308 and diameter 328, thickness 332 at the shoulder section 316, defined by a difference between diameter 307 and diameter 326, and/or thickness 333 at the neck section 317, defined by a difference between diameter 306 and diameter 329.

The primer cup 322 may be located at the distal end 312 of the cartridge case 302 (e.g., within the head section 313). The primer cup may be designed to receive a primer (not shown). The primer may be any combustible material, chemical, and/or combination thereof suitable for use as a primer within a firearm cartridge. Generally, the primer may promptly ignite when heated to a sufficient degree. For example, where the primer cup 322 is a component of a centerfire cartridge chambered in a firearm that is a centerfire handgun or rifle, the primer may promptly ignite when the primer cup 322 is struck by a firing pin of the firearm, which may cause such ignition by producing heated gas and/or sparks.

When located in the primer cup 322 within the cartridge case 302, the primer may rest adjacent to, and be accessible from, the chamber 318. As such, ignition of the primer may cause ignition of a propellant loaded within the chamber 318, such as propellant 338 (further described below). It will be understood by those having skill in the art that the primer, once ignited, may first cause ignition and subsequent combustion of a portion of any propellant 338 located closest to the primer cup 322 before ultimately igniting any portions of the propellant 338 farther from the primer cup 322. In this manner, the rate at which the propellant 338 combusts may vary depending on the potential distance of the propellant 338 from the primer cup 322, as may be determined by the design of the chamber 318 and/or any adjacent cavities, hollow volumes, and/or channels.

The projectile 304 may have diameter 334, which may be approximately the same as or less than the diameter 328 and/or the diameter 329 of the chamber 318. The projectile 304 may be insertable within the chamber 318. The projectile 304 may be any component suitable for use as a projectile within a firearm cartridge. For example, the projectile 304 may be a full metal jacket bullet, a soft-point bullet, a hollow-point bullet, a boat-tailed bullet, and/or any other suitable projectile. The projectile 304 may be formed from any material suitable for forming a projectile to be used within a firearm cartridge. For example, the projectile 304 may be formed from lead, lead alloy, jacketed lead, and/or any other suitable material.

The case wall 320 may be designed to be crimped, with the projectile 304 inserted or otherwise received in the chamber 318, about the neck section 317 at the mouth 319 of the cartridge case 302 (e.g., about the portion of the case wall 320 having thickness 333). Crimping the case wall 320 in this manner may form seal 337 between the projectile 304 and the case wall 320. The seal 337 may be airtight, thereby sealing the chamber 318 from an external environment about the firearm cartridge 300. As described with respect to FIG. 2, crimping the case wall 320 may be accomplished by any suitable crimping process, such as a taper-crimping process or a roll-crimping process.

The chamber 318 may include portion 342 and/or portion 344. Portion 344 may generally be located in the body section 314 of the cartridge case 302. Portion 342 may generally be located at a transition between the body section 314 and the shoulder section 316 of the cartridge case 302 and may connect portion 344 to the hollow volume 324 defined by the shoulder section 316. When the projectile 304 is inserted into the chamber 318 and secured in place via crimping, the projectile 304 and the case wall 320 may physically engage, abut, or contact one another at engagement 336, which may separate hollow volume 324 and portion 342 from portion 344 of the chamber 318.

The cartridge case 302 may be designed such that deformation of the case wall 320 in a preferred manner is facilitated (e.g., during obturation). For example, the hollow volume 324 defined by the shoulder section 316 may be designed such that an applied pressure required to deform the cartridge case 302 at the time of discharging the firearm cartridge 300 is less about thickness 332 of the case wall 320 than about thickness 330 of the case wall 320. Accordingly, pressurized gas generated during the discharge of the firearm cartridge 300 may provide sufficient pressure within the chamber 318 to deform (e.g., expand) a thinner portion of the case wall 320 (e.g., about the shoulder section 316) without noticeably deforming a thicker adjacent portion of the case wall 320 (e.g., about the body section 314). In this manner, deformation of the case wall 320 during discharge of the firearm cartridge 300 may cause an airtight seal to form between portion 342 and portion 344 of the chamber 318 about engagement 336.

The chamber 318 may be designed to receive propellant 338, for example, from the mouth 319 at the proximal end 310 of the cartridge case 302 before the projectile 304 has been inserted into the chamber 318 and/or before the case wall 320 has been crimped. The propellant 338 may be any combustible material suitable for use as a propellant in a firearm cartridge, including but not limited to gunpowder, black power, a black powder substitute, and/or a smokeless propellant. As further described below, a predetermined amount of the propellant 338 may be loaded into the chamber 318, depending on one or more desired discharge characteristics of the firearm cartridge 300.

The type of propellant 338 (as well as the predetermined amount of the propellant 338) to be loaded within the chamber 318 of the cartridge case 302 may be selected in conjunction with the projectile 304 to be inserted into the chamber 318 during production of the firearm cartridge 300. For example, the projectile 304 may only be insertable within the chamber 318 to distance 340 from the distal end 312 of the cartridge case 302. The distance 340 may be based on the predetermined amount of the propellant 338, which may already be loaded within the chamber 318 when the projectile 304 is to be inserted. In other words, the projectile 304 may only be inserted to a distance 340 such that the propellant 338 does not interfere with the insertion due to limited available volume within the chamber 318. In this manner, the particular load of the firearm cartridge 300 may be based, at least in part, on the predetermined amount of the propellant 338 loaded within the chamber 318, the projectile 304 inserted into the chamber 318, and/or the distance to which the projectile 304 may be inserted into the chamber 318. Moreover, the possible loads of the firearm cartridge 300 may be limited, at least in part, by the design and resultant characteristics of the cartridge case 302.

In some embodiments, the distance 340 may be greater than that illustrated in FIG. 3, for example, the projectile 304 may be only inserted into the neck section 317, and no further. In other embodiments, as shown in FIG. 3, the projectile 304 may be inserted all the way into the body section 314.

Should the firearm cartridge 300, including the propellant 338 and the projectile 304, be chambered in a firearm and subsequently discharged, the propellant 338 may be ignited (e.g., responsive to ignition of the primer within the primer cup 322). Once ignited, the propellant 338 may begin to burn, thereby generating a volume of pressurized gas within the chamber 318. The pressurized gas may force the projectile 304 forward from the cartridge case 302, via the mouth 319 at the proximal end 310, at a velocity. The projectile 304 may then travel through the air or atmosphere surrounding the firearm until contacting a target or another mass.

A rate at which the propellant 338 burns (i.e., the burn rate of the propellant 338) may be based on numerous factors and may determine one or more performance characteristics of the firearm cartridge 300 and/or its various components. For example, the burn rate of the propellant 338 may be affected by an attitude (i.e., angle of orientation) of the firearm in which the firearm cartridge 300 may be chambered. As the attitude of the firearm is adjusted, the propellant 338 may shift about the chamber 318, thereby affecting the relationship of the propellant 338 to the primer within the primer cup 322 during ignition and subsequent combustion. Put another way, the propellant 338 may burn more or less consistently or uniformly depending on the extent to which the propellant 338 may shift about the chamber 318.

In the present embodiment, for example, the propellant 338 may be restricted to shifting only about portion 344 of the chamber 318 because the engagement 336 formed between the case wall 320 and the projectile 304 may effectively seal or otherwise physically separate the portion 344 from the portion 342 and the hollow volume 324, particularly as obturation deforms the case wall 320 about the projectile 304. As such, the firearm cartridge 300 may be designed to prevent the propellant 338 from shifting to those portions of the chamber 318 farthest from the primer cup 322, thereby providing for a more consistent or uniform burn rate than would be feasible with a different firearm cartridge where propellant might shift freely about the entirety of the chamber within the cartridge case.

By providing for a more consistent or uniform burn rate in this manner, even at extreme attitudes of the firearm, the firearm cartridge 300 may offer numerous improved performance characteristics. In one respect, the burn rate of the propellant 338 may affect the velocity, range, and/or accuracy with or to which the projectile 304 may travel. Accordingly, a more consistent or uniform burn rate may provide for reduced deviations in velocity, which may improve the consistency of the range to which the projectile 304 may travel and/or the accuracy with which the projectile 304 may reach a preferred target. Providing for a uniform burn rate may also result in cleaner combustion of the propellant 338, which may reduce fouling of the firearm over time.

As with firearm cartridge 200, the firearm cartridge 300 may be any firearm cartridge suitable for use with a firearm (e.g., a centerfire cartridge suitable for use with a centerfire handgun or rifle). The firearm cartridge 300 may also be of any suitable caliber. In some embodiments, the firearm cartridge 300 may be designed to operate at reduced velocities as compared to a different firearm cartridge of a similar caliber. For example, the firearm cartridge 300 may be a subsonic firearm cartridge designed to operate at velocities below the speed of sound, thereby providing numerous benefits of subsonic operation (e.g., noise reduction).

Where the firearm cartridge 300 may be a subsonic firearm cartridge, one or more characteristics of the firearm cartridge 300 and/or associated components may be optimized for subsonic operation. For example, the load of the firearm cartridge 300 may be a subsonic load, which may be associated with the predetermined amount of the propellant 338 to be loaded within the chamber 318, one or more characteristics of the projectile 304, and/or the distance 340 to which the projectile 304 may be inserted into the chamber 318. The predetermined amount of the propellant 338 may be a lesser amount of the propellant 338 than might otherwise be loaded within the chamber 318. In this manner, the predetermined amount of the propellant 338 may be less than an amount of the propellant 338 that would be required for supersonic operation of the firearm cartridge 300 or a different firearm cartridge of a similar caliber. Alternatively, or in addition, one or more characteristics of the projectile 304, including but not limited to weight, material(s), and/or one or more dimensions (e.g., surface profile), may be selected for subsonic operation. As such, the projectile 304 may be heavier and/or provide greater wind resistance during travel, as compared to a different projectile, which may provide for a reduced velocity during travel versus the different projectile.

The cartridge case 302 may be designed and/or modified to accommodate one or more different loads of the firearm cartridge 300, such as a reduced-velocity load or a subsonic load. For example, the cartridge case 302 may or may not be shortened in overall length (e.g., by cutting down the cartridge case 302 about the proximal end 310), based on the predetermined amount of the propellant 338 required for a subsonic load, as compared to a similar cartridge case designed for use with a supersonic load in a similar caliber. Alternatively, or in addition, one or more dimensions of the case wall 320 may be designed and/or modified (e.g., by drilling and/or reaming about the chamber 318) to accommodate the projectile 304 and/or the predetermined amount of the propellant 338 associated with a preferred load of the firearm cartridge 300. For example, an internal portion of the casing material may be removed from the shoulder section 316 and/or the neck section 317 such that the resulting diameter 326 and/or diameter 329 may accommodate the diameter 334 of the projectile 304. Alternatively, or in addition, an external portion of the casing material may be removed from the cartridge case 302 such that the case wall 320 has one or more preferred thicknesses (e.g., thickness 330, thickness 332, and/or thickness 333) to facilitate obturation based on the lesser relative volume of pressurized gas generated by a reduced-velocity load or a subsonic load.

With various designs of the cartridge case 302, including but not limited to those using a metallic material (e.g., brass or aluminum) as the casing material, the cartridge case 302 may seal or bind against the projectile 304 during a discharge of the firearm involving the firearm cartridge 300. Such sealing, or obturation, may occur when the case wall 320 expands or otherwise deforms to fill the chamber 318 as the projectile 304 exits the cartridge case 302 via the mouth 319 at the proximal end 310.

Depending on whether and/or to what extent the overall length of the cartridge case 302 may have been shortened and/or the case wall 320 may have been selectively thinned, deformation of the case wall 320 to accommodate the projectile 304 during such obturation may be accomplished with varying degrees of effectiveness. For example, were the cartridge case 302 to be improperly shortened, the projectile 304 might need to be seated at an improper distance from the distal end 312 of the cartridge case 302, which might have adverse effects with respect to obturation and/or the velocity of the projectile 304 upon exiting the cartridge case 302. Similarly, were the entirety of the case wall 320 to be thinned in a substantially uniform manner, the case wall 320 might become excessively rigid when tightly fitted against the projectile 304 and thereby prevent an effective seal from forming during obturation.

Accounting for these and other issues associated with obturation, inclusion of the hollow volume 324 defined by the shoulder section 316 of the cartridge case 302 may result in the case wall 320 having thickness 332 about the shoulder section 316, which may be less than thickness 330 of the case wall 320 about at least a portion of the body section 314 of cartridge case 302 but greater than thickness 333 of the case wall 320 about the neck section 317. As shown in FIG. 3, for example, the inner profile of the hollow volume 324 may have a funnel shape. Alternatively, the inner profile may have any other shape suitably associated with the selective thinning of the case wall 320 described herein. The inner profile of the hollow volume 324 may be formed using any suitable process. For example, a portion of the casing material may be removed from the case wall 320 about the shoulder section 316 by a boring or threading process. Alternatively, or in addition, a different portion of the casing material may be removed about the neck section 317 by a drilling or reaming process. As such, the case wall 320 may become progressively thinner from the body section 314 toward the mouth 319 of the cartridge case 302.

Such selective thinning of the case wall 320 may provide for reduced strength of the case wall 320, for example, about the shoulder section 316 and/or the neck section 317. As such, the case wall 320 may be able to preferably deform during obturation, thereby sealing the chamber 318 about the projectile 304 (e.g., at engagement 336) during exit of the projectile 304 via the mouth 319 at the proximal end 310. Importantly, preferable deformation may restrict the propellant 338 to portion 344 of the chamber 318 during discharge of the firearm cartridge 300, while reduced thickness of the case wall 320 about portion 342 of the chamber 318 and the adjacent hollow volume 324 may provide for greater expansion of the case wall 320 about the shoulder section 316 and/or at least an adjacent part of the neck section 317. In this manner, the propellant 338 may not enter the portion 342 or the hollow volume 324 at any time during the discharge while at least part of the projectile 304 remains within the body section 314, during which time the engagement 336 similarly remains.

It will be understood by those having skill in the art that selective thinning of the case wall 320 need not necessarily be performed solely about the shoulder section 316 and/or the neck section 317 of the cartridge case 302, as long as any additional selective thinning provides one or more preferred performance characteristics of the firearm cartridge 300 related to obturation, scaling, and/or shifting of the propellant 338 within the chamber 318. For example, additional selective thinning of the case wall 320 may be performed about any portion of the case wall 320 accessible from within the chamber 318 of the cartridge case 302. In other words, one or more dimensions of the case wall 320 may be modified to accommodate a wider range of loads during production of the firearm cartridge 300 while still deforming in a preferable manner during discharge of the firearm cartridge 300.

The engagement 336 that results from inserting the projectile 304 into the chamber 318 of the cartridge case 302 may prevent undesirable shifting of the propellant 338 loaded within the chamber 318. This may limit the propellant 338 to a tighter volume and thereby regulate the burn rate of the propellant 338 by ensuring a more uniform distance of any portion of the propellant 338 from the primer at a time of ignition. For example, the engagement 336 may separate portion 344 of the chamber 318 from portion 342 and/or from the hollow volume 324 that may be included to facilitate obturation. As such, the propellant 338 may be prevented from entering the portion 342 and/or the hollow volume 324, regardless of how the firearm cartridge 300 may be angled or otherwise oriented during operation. It will, of course, be understood by those having skill in the art that firearm cartridges may be oriented at numerous, sometimes substantial, angles when chambered in firearms that have been adjusted to equally numerous attitudes prior to discharge. By providing for the engagement 336 between the projectile 304 and the case wall 320 of the cartridge case 302, the firearm cartridge 300 may offer more uniform burn rates, as well as preferable obturation properties, that are notably lacking from existing firearm cartridges. Such improvements may be particularly noticeable over existing firearm cartridges with subsonic loads, which may require reduced amounts of propellant and thereby provide for greater shifting about given internal volumes of the cartridge cases.

Advantageously, with further respect to the firearm cartridge 300, the engagement 336 separating portion 344 of the chamber 318 of the cartridge case 302 from portion 342 of the chamber 318 and/or the hollow volume 324 may be formed without requiring an additional scaling component. For example, the propellant 338 need not be interspersed with a filler material. Moreover, the case wall 320 need not be supplemented by one or more polymer or intermediate walls. As such, the cartridge case 302 may provide for improved reliability and/or scaling over existing cartridge cases of firearm cartridges. Providing for the engagement 336 in this manner may, however, require a close tolerance between the diameter 334 of the projectile 304 and the diameter 328 of the chamber 318 within the body section 314. Because the diameter 334 and the diameter 328 may be the same or almost the same as one another, deformation of the case wall 320 may be inherently limited about engagement 336 due to tightness of fit between the case wall 320 and the projectile 304. Inclusion of the hollow volume 324 about the shoulder section 316 of the cartridge case 302 may, therefore, provide for necessary weakening of the case wall 320 about the shoulder section 316 to facilitate expansion of the cartridge case 302 during discharge of the firearm cartridge 300.

The various components described herein may be formed, produced, or constructed from any suitable material. For example, the cartridge case 302 may be formed from any metal (e.g., copper, mild steel, aluminum, and/or brass), polymer, plastic, composite material, or any other material suitable for forming a cartridge case as described herein. In a similar manner, the various other components described herein may be formed from any material(s) suitable for the designs, purposes, and/or functionalities described herein. It will be understood by those having skill in the art that numerous other materials are further envisioned by the present disclosure and that any materials specifically mentioned herein are provided simply by way of example.

It will further be understood that any of the various components described herein may be designed for use independent from any other component(s). For example, while the cartridge case 302 is described herein as a component of the firearm cartridge 300, the cartridge case 302 may nonetheless be used independently from the firearm cartridge 300. Accordingly, the cartridge case 302 may be used with any firearm cartridge. Similar ranges of use are envisioned with respect to the numerous other components described herein.

Figure 4:
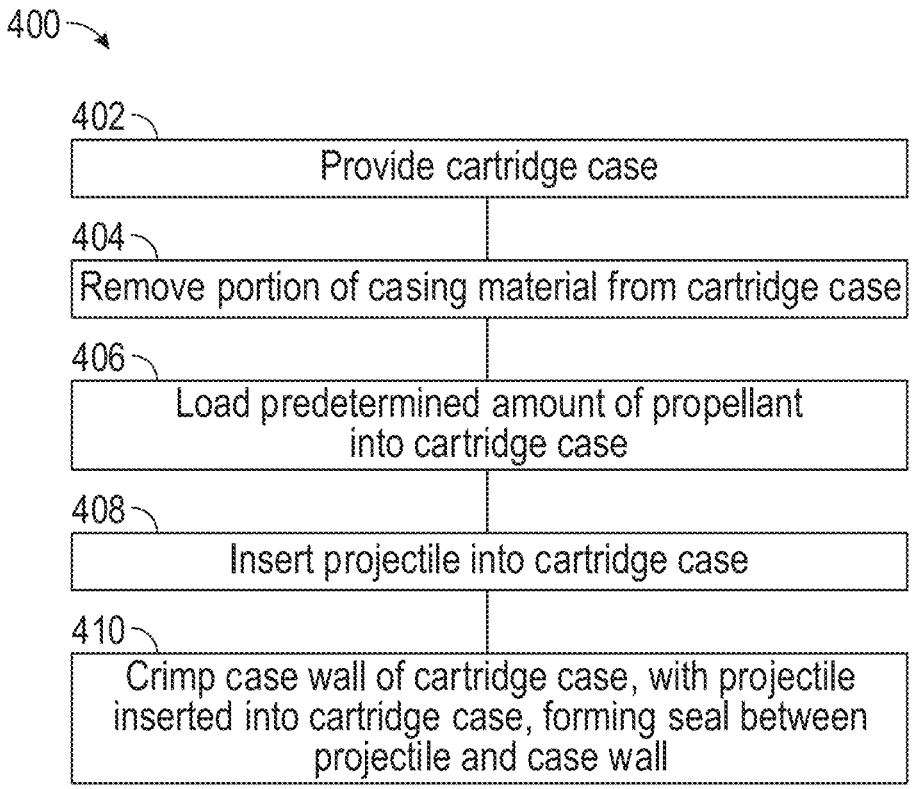
FIG. 4 is a schematic illustration of an example process flow for manufacturing a firearm cartridge in accordance with one or more example embodiments of the disclosure.

Referring now to FIG. 4, and in brief overview, an example process flow for manufacturing a firearm cartridge in accordance with one or more embodiments of the present disclosure is illustrated. As shown in FIG. 4, process flow 400 may include block 402, block 404, block 406, block 408, and/or block 410. It should be appreciated that the operations of the process flow 400 may be optional, may be performed in any order, and/or may include additional or alternative operations described herein or otherwise envisioned by the present disclosure but not illustrated in FIG. 4, as will be understood by those having skill in the art. It will further be understood that the firearm cartridge in FIG. 4 may be the same as or similar to firearm cartridge 200 of FIG. 2, firearm cartridge 300 of FIG. 3, or otherwise may be one or more of the firearm cartridges of FIGS. 2-3. In a similar manner, the various components associated with the firearm cartridge of FIG. 4 may be the same as or similar to one or more components associated with the firearm cartridge 200 of FIG. 2, the firearm cartridge 300 of FIG. 3, or otherwise may be one or more of the components associated with one or more firearm cartridges of FIGS. 2-3.

At block 402, a cartridge case may be provided. The cartridge case may be formed from one or more casing materials. The cartridge case may include a head section, a body section, a shoulder section, and a neck section that may be defined by an outer profile extending transversely from a proximal end of the cartridge case to a distal end of the cartridge case. The outer profile may have multiple diameters, such as a first diameter at the neck section, a second diameter at the shoulder section, and/or a third diameter at the body section. For example, the outer profile may taper between the proximal end and the distal end, the proximal end having a smaller diameter than the distal end, such that the outer profile may have one or more preferred aerodynamic characteristics.

The cartridge case may include a case wall that defines a chamber with a mouth at the proximal end and/or a primer cup at the distal end (e.g., within the head section). The shoulder section may be located between the body section and the neck section. The outer profile defining the cartridge case may taper about the shoulder section. The chamber may have at least a fourth diameter within the body section and/or a fifth diameter within the neck section (which may be the same as or different than the fourth diameter) and/or may extend transversely from the proximal end, through the neck section and the shoulder section, and toward the distal end through at least a portion of the body section. The chamber may be designed to receive an amount of a propellant, such as by a loading or packing process, from the proximal end at the mouth. The chamber may further be designed to receive a projectile, such as by insertion, from the proximal end at the mouth. The case wall may have at least a first thickness at the body section, defined by a difference between the third diameter and the fourth diameter, and/or a second thickness at the neck section, defined by a difference between the first diameter and the fifth diameter. The first thickness and/or the second thickness of the case wall may or may not be sufficiently weak to provide for acceptable deformation of the case wall responsive to a discharge of a firearm in which the firearm cartridge may be chambered. In other words, the first thickness and/or the second thickness may or may not provide for effective obturation of the cartridge case during the discharge.

It should be appreciated that the cartridge case may be independently formed from the casing material(s) or otherwise modified from a different cartridge case. For example, the cartridge case may be independently formed by at least turning the casing material to produce the outer profile, as well as the body section, the shoulder section, and the neck section, and drilling and/or reaming the casing material from the proximal end to produce the chamber. The case wall may be defined by the portion of the casing material remaining between the outer profile and the chamber. An overall length of the cartridge case may be determined by an original length of the casing material and/or by a portion of the casing material removed about the proximal end and/or the distal end in forming the cartridge case.

Alternatively, the cartridge case may be modified from a different cartridge case including a different chamber. The overall length of the cartridge case may be modified, for example, by cutting down or otherwise removing a portion of the different cartridge case between the proximal end and the shoulder section (e.g., by cutting down the neck section). As such, the overall length of the cartridge case may be less than that of the different cartridge case, which may produce a chamber having a lesser depth than that of the different chamber. The outer profile of the cartridge case may be modified, such as by a turning process. The chamber that may be produced may further be drilled and/or reamed from the proximal end such that the chamber may have one or more diameters (e.g., the fourth diameter within the body section and/or the fifth diameter within the neck section provided for at block 402) that may be greater than a different diameter associated with the different chamber. It will be understood by those having skill in the art that modifying the different cartridge case in these or other manners may result in the cartridge case having one or more performance characteristics that differ from those of the different cartridge case when used as a component of the firearm cartridge. For example, one or more points about the case wall of the cartridge case may be stronger or weaker than one or more corresponding points of the different cartridge case.

At block 404, a portion of the casing material may be removed from the cartridge case. For example, the portion of the casing material may be removed from about an internal surface of the shoulder section, such as by a boring or threading process. As such, a hollow volume located within the case wall and accessible from the chamber may be formed, thereby defining a third thickness about the shoulder section. Inclusion of the hollow volume within the case wall may affect one or more performance characteristics of the cartridge case. For example, the case wall may be weaker about the hollow volume than generally about the chamber, which may result from a varying thickness of the case wall about the cartridge case. By selectively thinning the case wall in this manner, the cartridge case may preferably deform upon discharge of a firearm in which a firearm cartridge including the cartridge case may be chambered. For example, upon such a discharge, the cartridge case may provide for improved obturation versus the different cartridge case not including the hollow volume. The cartridge case may be further optimized based on a selected shape of the hollow volume. For example, the hollow volume may have a funnel shape, or otherwise may have any suitable shape for selectively thinning the case wall.

Alternatively, or in addition, the chamber may be modified (e.g., by drilling and/or reaming through the neck section, the shoulder section, and/or part of the body section) to remove another portion of the casing material. In this manner, at least three non-uniform thicknesses of the case wall may be produced. For example, the case wall may have the first thickness at the body section and the second thickness at the neck section, as well as the third thickness at the shoulder section, which may be an intermediate thickness between the first thickness and the second thickness. Put another way, the case wall may decrease in thickness along the transverse axis of the cartridge case from the body section to the neck section via the shoulder section. Unlike different cartridge cases with case walls having more or less uniform thicknesses, the cartridge case described herein may provide for a more dynamic and optimizable response to a discharge of a firearm with which the cartridge case may be associated. For example, the cartridge case may preferably deform during obturation as opposed to a different cartridge case with a case wall having a more or less uniform thickness.

At block 406, a predetermined amount of a propellant may be loaded within the cartridge case. For example, the predetermined amount of the propellant may be loaded into the chamber from the proximal end of the cartridge case at the mouth of the chamber. The predetermined amount of the propellant may be associated with a load of the firearm cartridge. For example, where the load may be a subsonic or reduced-velocity load, the predetermined amount may include ten to twenty percent less propellant than that associated with a supersonic or high-velocity load of a similar firearm cartridge. As such, an amount of energy generated by combustion of the propellant during discharge of a firearm in which the firearm cartridge may be chambered may be reduced or otherwise modified from the amount of energy generated in association with a supersonic load.

Because the predetermined amount of the propellant associated with the subsonic or reduced-velocity load may leave a greater volume of empty space remaining within the chamber, it should be appreciated that the propellant may not be as tightly packed as it might otherwise be for a supersonic load. Accordingly, a burn rate of the propellant may be affected, particularly when an attitude of the firearm in which the firearm cartridge is chambered may be adjusted, thereby altering relative distances of various portions of the propellant from an initial point of ignition within the cartridge case (e.g., a location of a primer).

At block 408, the projectile may be inserted into the cartridge case. For example, the projectile may be inserted into the chamber from the proximal end of the cartridge case at the mouth of the chamber to a predetermined distance from the distal end of the cartridge case. The predetermined distance may be determined, at least in part, by the fourth diameter of the chamber within the body section and/or the fifth diameter of the chamber within the neck section, which may each be sufficiently wide or narrow to, respectively, allow or limit travel of the projectile within the pertinent section of the cartridge case. When the projectile is inserted into the chamber of the cartridge case, the projectile and the case wall may physically engage, abut, or contact one another at an engagement, which may separate the hollow volume and an adjacent portion of the chamber from the remainder of the chamber. As such, the propellant may be prevented from entering the hollow volume or the adjacent portion of the chamber from the remainder of the chamber, regardless of whether the attitude of the firearm in which the firearm cartridge is chambered may be adjusted. Because the propellant may be restricted to a smaller volume of the chamber by the engagement, the burn rate of the propellant may remain consistent even if the firearm is adjusted to an extreme attitude prior to discharge of the firearm cartridge.

Alternatively, or in addition, the predetermined distance may correspond to the predetermined amount of the propellant because the propellant may not interfere with the projectile within the chamber. Moreover, the predetermined distance may limit the volume of empty space remaining in the chamber, thereby determining how tightly the propellant may be packed within the chamber (and, as such, the burn rate of the propellant). The projectile may be any one of numerous projectiles, including but not limited to those described with respect to projectile 304 of FIG. 3.

Worth briefly reiterating, the projectile may be formed from one or more materials and/or be characterized by a weight and/or one or more dimensions corresponding to one or more loads of the firearm cartridge, such as subsonic or reduced-velocity loads. Together, the predetermined amount of the propellant, the projectile, and/or the predetermined distance of the projectile from the distal end of the cartridge case may, alone or in combination with one or more other factors, define the load of the firearm cartridge. For example, the predetermined amount of the propellant, the projectile, and/or the predetermined distance of the projectile from the distal end of the cartridge case may be defined as or otherwise correspond to a subsonic or reduced-velocity load.

At block 410, the case wall of the cartridge case may, with the projectile inserted into the cartridge case, be crimped, thereby forming a seal between the projectile and the case wall. For example, the case wall may be crimped about the mouth of the chamber, with the projectile inserted into the chamber to the predetermined distance from the distal end of the cartridge case, such that the seal may be formed by the projectile and the case wall. The seal may be airtight and may separate the chamber of the cartridge case from an external environment.

Crimping the case wall may be accomplished by any suitable crimping process. For example, the case wall may be crimped by a taper-crimping process or a roll-crimping process. Selection of the taper-crimping process or the roll-crimping process may be based on the firearm in which the firearm cartridge may be chambered. The taper-crimping process may be preferred when the firearm is a semiautomatic handgun or rifle, whereas the roll-crimping process may be preferred when the firearm is a revolver or otherwise chambered in one of certain large calibers.

Crimping the case wall may secure the projectile in place within the chamber of the cartridge case. A resulting volume between the seal and the engagement (i.e., the hollow volume and the adjacent portion of the chamber) may be securely isolated from the remainder of the chamber. This may remain the case during discharge of the firearm cartridge, including during obturation, particularly where the engagement between the projectile and the case wall restricts any noticeable deformation of the case wall. In this manner, the cartridge case may be designed and/or modified to include elements facilitating obturation (e.g., the hollow volume located in the case wall and/or the varying thicknesses of the case wall about the body section, the shoulder section, and the neck section), while simultaneously providing for an improved burn rate of the propellant loaded into the chamber of the cartridge case. Accordingly, the cartridge case may offer a preferable design for use as a component of a firearm cartridge, particularly where the firearm cartridge is associated with a reduced-velocity or subsonic load presenting the various performance challenges described throughout the present disclosure.

The firearm cartridge manufactured during process flow 400 may be a centerfire cartridge, or may otherwise be any other suitable firearm cartridge that may be manufactured by the operations of block 402, block 404, block 406, block 408, block 410, and/or one or more additional or alternative operations described herein or otherwise envisioned by the present disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A firearm cartridge, comprising:

a projectile; and a cartridge case, comprising:

a head section;

a body section, adjacent to the head section;

a shoulder section, adjacent to the body section; and a neck section, adjacent to the shoulder section, wherein the cartridge case includes a case wall, the case wall defining a chamber that extends from the head section to the neck section and having at least a first thickness about the body section and a second thickness about the shoulder section, wherein the second thickness is less than the first thickness, wherein the case wall about the neck section engages with the projectile, and wherein at least a portion of the case wall at the body section is in contact with the projectile, and wherein the case wall about the shoulder section defines a hollow volume, and wherein the hollow volume is configured such that an applied pressure required to deform the cartridge case is less where the case wall has the second thickness than where the case wall has the first thickness.

2. The firearm cartridge of claim 1, wherein the applied pressure is generated by obturation during a discharge of the firearm cartridge, and wherein the cartridge case is configured to deform during the obturation such that an engagement forms an airtight seal between a first chamber portion and a second chamber portion.

3. The firearm cartridge of claim 2, wherein the hollow volume has a funnel shape.

4. The firearm cartridge of claim 1, wherein the case wall has a third thickness about the neck section, and wherein the third thickness is less than the first thickness and the second thickness.

5. The firearm cartridge of claim 1, wherein the case wall is configured to be crimped about the neck section such that a seal separating the chamber from an external environment is formed by the projectile and the case wall.

6. The firearm cartridge of claim 1, wherein the projectile includes a first end and an opposite second end, and wherein the first end is inserted into the chamber of the cartridge case beyond the shoulder section.

7. The firearm cartridge of claim 6, wherein the chamber is separated into a first chamber portion within the body section and a second chamber portion within the shoulder section by an engagement between the projectile and the case wall, and wherein the engagement is configured to prevent the propellant from entering the second chamber portion and/or a hollow volume from the first chamber portion when an attitude of a firearm in which the firearm cartridge is chambered is adjusted.

8. The firearm cartridge of claim 6, wherein the chamber is further configured to receive a predetermined amount of the propellant, wherein the first end of the projectile is disposed within the chamber at a predetermined distance from the head section, and wherein the predetermined amount and the predetermined distance correspond to a subsonic or reduced-velocity load of the firearm cartridge.

9. A firearm cartridge case, comprising:

a head section;

a body section, adjacent to the head section;

a shoulder section, adjacent to the body section; and a neck section, adjacent to the shoulder section, wherein the firearm cartridge case includes a case wall, the case wall defining a chamber that extends from the head section to the neck section and having at least a first thickness about the body section and a second thickness about the shoulder section, wherein the second thickness is less than the first thickness, and wherein the body section has a first inside diameter, the neck section has a second inside diameter, and the shoulder section has a third inside diameter, wherein the third inside diameter is greater than the first inside diameter and the second inside diameter.

10. The firearm cartridge case of claim 9, wherein the first inside diameter and the second inside diameter are approximately equal.

11. The firearm cartridge case of claim 9, wherein the third inside diameter varies along a longitudinal length of the cartridge case.

12. The firearm cartridge case of claim 9, wherein the case wall has a third thickness about the neck section, and wherein the third thickness is less than the first thickness and the second thickness.

13. The firearm cartridge case of claim 9, wherein the firearm cartridge is a centerfire cartridge.

14. The firearm cartridge case of claim 9, further comprising a projectile at least partially disposed in the cartridge case.

15. The firearm cartridge case of claim 14, wherein the shoulder section and the projectile form a hollow volume.

16. A method for manufacturing a firearm cartridge, comprising:

providing a cartridge case, wherein the cartridge case comprises:

a head section;

a body section, adjacent to the head section;

a shoulder section, adjacent to the body section; and a neck section, adjacent to the shoulder section, wherein the cartridge case includes a case wall, the case wall defining a chamber that extends from the head section to the neck section and having at least a first thickness about the body section, removing a portion of the case wall from within the chamber such that the case wall about the shoulder section defines a hollow volume and has a second thickness that is less than the first thickness;

loading a predetermined amount of a propellant into the first chamber portion;

inserting a projectile into the chamber to a predetermined distance from the head section such that an engagement is formed between at least the neck section and the projectile; and crimping the case wall about the neck section such that a seal separating the chamber from an external environment is formed by the projectile and the case wall.

17. The method of claim 16, wherein the wall about the neck portion has a third thickness that is less than that of the first thickness.

* * * * *